US005824378A

United States Patent [19]

Armendariz et al.

[11] Patent Number: 5,824,378

[45] Date of Patent: Oct. 20, 1998

[54] FOLDABLE PINATA

[75] Inventors: Esther Armendariz; Victor Mireles; Michael Angel Balibrera, all of El Paso, Tex.

[73] Assignee: Aztec Imports Inc., El Paso, Tex.

[21] Appl. No.: 436,962

[22] Filed: May 8, 1995

[51] Int. Cl.[6] ..... A63H 33/00

[52] U.S. Cl. ..... 428/7; 428/34.1; 446/5

[58] Field of Search ..... 428/7, 34.1; 446/5, 446/387; 229/116.3

[56] References Cited

U.S. PATENT DOCUMENTS

| | | | |
|---|---|---|---|
| 1,438,083 | 12/1922 | Baker | 229/116.3 X |
| 1,485,144 | 2/1924 | Morgan | 229/116.3 |
| 2,170,953 | 8/1939 | Spots | 229/116.3 X |
| 3,702,675 | 11/1972 | Bajo | 428/7 X |
| 3,983,658 | 10/1976 | de Sanz | 428/7 X |
| 4,167,078 | 9/1979 | Oquita | 446/5 |
| 4,253,266 | 3/1981 | Bajo | 446/5 |
| 4,832,337 | 5/1989 | Estrada | 446/5 X |
| 5,332,605 | 7/1994 | De Lamar | 428/15 |
| 5,536,194 | 7/1996 | Larsen et al. | 446/5 |

*Primary Examiner*—Henry F. Epstein
*Attorney, Agent, or Firm*—Betty Formby; Robert Groover

[57] ABSTRACT

An innovative method of making piñatas utilizes pre-cut and scored cardstock designed with tab and slot closures. Once the shapes are folded and secured, the piñatas can be decorated using traditional or innovative methods. By designing the tab/slot closure of the body on the bottom of the piñata, the enclosed treats may be released in a non-destructive manner.

20 Claims, 5 Drawing Sheets

FOLDABLE PINATA

BACKGROUND AND SUMMARY OF THE INVENTION

The present invention relates to piñatas, and to methods of making them.

Piñatas have been in use on festive occasions since the early sixteenth century. First used in Italy, they were originally a simple clay pot which could be filled with treats and suspended by a rope. Individuals were blindfolded and given a stick with which they could attempt to break the piñata. Once the piñata was broken, everyone scrambled for the released treats. The custom was brought to the Americas by the early Spanish explorers, and until the early 20th century the basic design remained the same—a plain, undecorated clay pot. With the arrival of tissue paper, Mexicans began to decorate their piñatas with fanciful colors and designs. Tourists travelling in Mexico became enchanted with the colorful piñatas and the demand increased, thereby encouraging the manufacturers to find a faster method of making the piñatas.

In the 20th century manufacturers began to make piñatas out of paper mâché, and that has remained the method of choice until now. Using paper mâché, they could make piñatas in many shapes, often giving them the form of bulls, stars, donkeys, etc.

The method for making piñatas out of paper mâché involves the following basic steps: 1) A support structure is formed, e.g. rolled or wadded newspapers, balloons, or Styrofoam® (an expanded polystyrene plastic) blocks. 2) Strips of newspaper (e.g. approximately 2" wide) are dipped in a paste and layered over the support form to cover it completely. 3) "Appendages" may be added while the piñata is still wet, i.e. any part (such as a donkey's ears) which does not need to be a part of the main container. 4) The piñata must then be allowed to dry completely. 5) Once dry, the piñata is cut in half to remove the support structure, and the two halves fastened together with tape. 6) A hole is made in the piñata to allow treats to be added by the purchaser and a rope or wire is secured to allow the piñata to be suspended properly. 7) The piñata is now ready to be decorated, traditionally with tissue paper cut in fringed strips.

Although paper mâché piñatas have been successfully used for over 50 years, there are several drawbacks to this method. A great deal of time and skill are needed to form the paper mâché shapes in an artistic and consistent manner. Once the piñatas are formed, they need a long time to dry properly and their often bulky forms take up a large amount of space. Shipping can also be a problem, since they are bulky and at least somewhat fragile by nature. Also, paper mâché piñatas don't break as easily as the clay pots formerly used; they often fold in on themselves rather than shattering.

Attempts have been made to find new methods of making the piñatas, such as corrugated cardboard hot-glued together, but the invention here disclosed is a significant new method.

Functionally, a piñata design has several requirements:

- it must hold a substantial volume and weight (perhaps 2–5 pounds) of treats,
- it must be capable of being suspended when filled without spilling its contents,
- it must break when struck firmly or have another means of releasing the enclosed treats on demand.

These problems are solved, in the presently preferred embodiment, by an inventive process which uses paperboard packaging technology in a new way. Decorative shapes are designed and translated into die-cut and scored cardstock pieces which can be hand folded into full-size three-dimensional forms and secured with built-in tabs and slots. Two, three, or more pieces can be fit together to form elaborate and fanciful shapes, such as animals, human figures or inanimate objects. By providing a large number of parallel fold lines, a circular shape, such as a torso, can be approximated. The scored cardstock includes a precut opening for adding treats and a suitable place for attachment of a wire or other hanger. In a short amount of time, a finished piñata can be ready for decorating.

The advantages of the paperboard method are numerous. There is no time-consuming layering of paper mâché, nor waiting for the paper mâché to dry, and no need to remove the support structure and refasten the pieces. The folding can be done with a minimum of skill, yet the finished forms are consistent and proportionate (unlike traditional piñatas) and rival the work of a skilled artisan. If desired, the pieces can even be shipped flat, to be assembled at the destination and decorated by the consumer, thus saving on shipping costs.

Another innovative feature, which provides further advantages is that the paperboard piñata has a "trap door" in the bottom. A string or ribbon can be attached nearby to open the piñata with a tug. This allows the piñata to be used in a non-destructive way, as will be detailed below. It also provides a way of making piñatas reusable, as well as providing a less violent game, which some parents may prefer.

BRIEF DESCRIPTION OF THE DRAWINGS

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

Figure 1A:
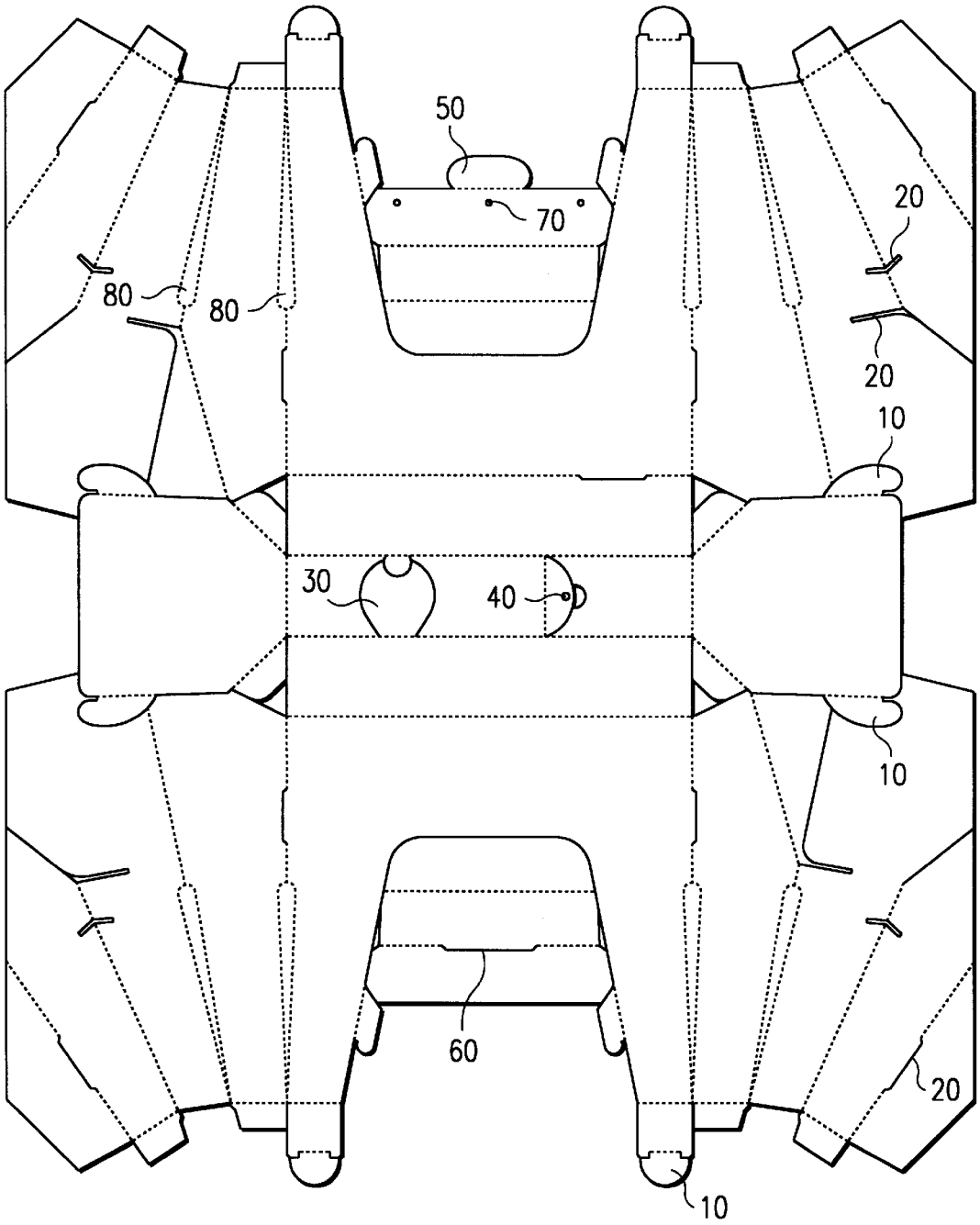
FIGS. 1A, 1B, and 1C show the three pieces of one cut-and-fold pattern used in the making of piñatas.
Figure 1B:
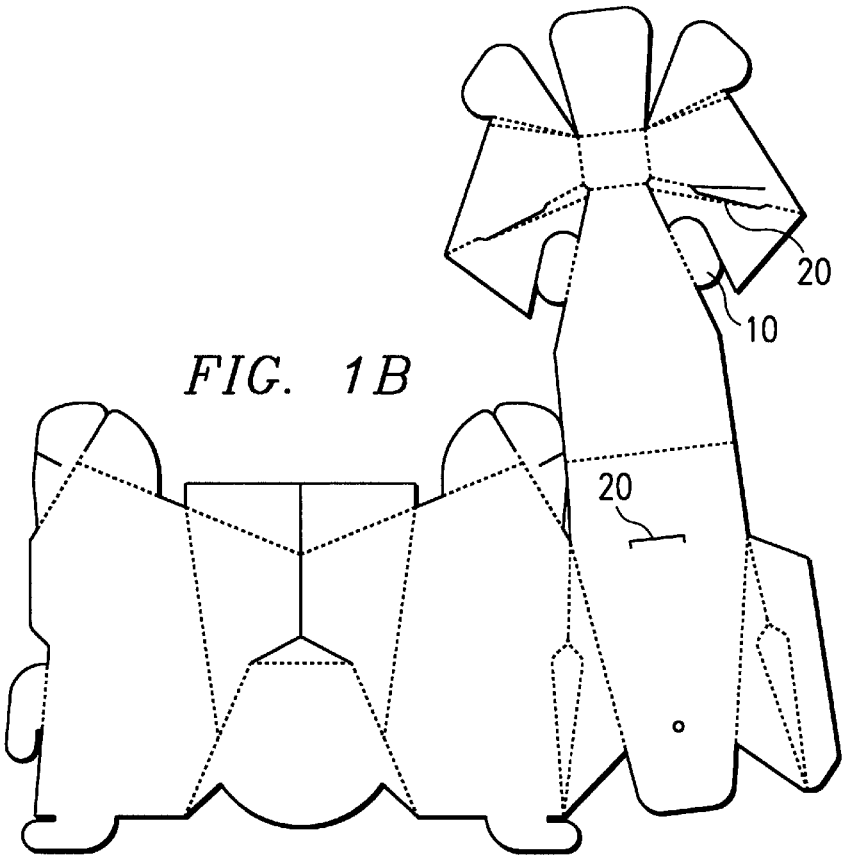
Figure 1C:
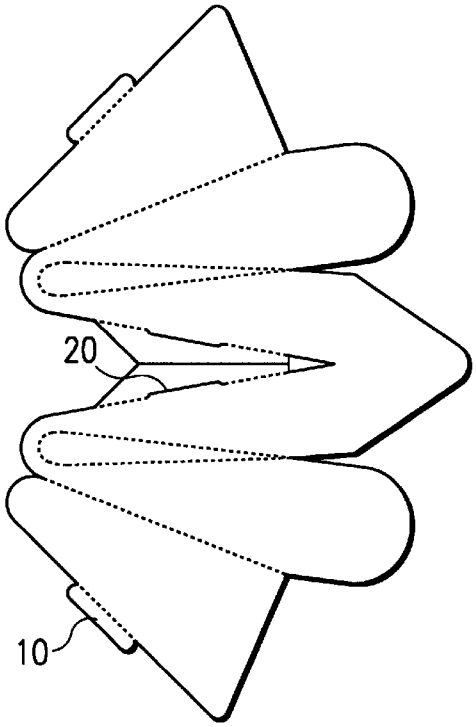

The numerous innovative teachings of the present application will be described with particular reference to the presently preferred embodiment (by way of example, and not of limitation), in which:

FIGS. 1A, 1B, and 1C show an example of a pattern for a piñata. All three pieces are used to make piñatas in the shape of a burro; using only 1A and 1B, a dog or horse is possible. In the presently preferred embodiment, the patterns are die cut and scored out of 24-point cardstock. The design includes tabs (10) and slots (20) which will be used to fasten the pieces together in the required manner, as well as score lines for ease in folding into the desired shape. The first piece, as shown in FIG. 1A will form the "body" of the piñata and hold the added treats, so the pattern includes a substantially circular opening (30) with a flap for adding candy and other treats after decoration. In the presently preferred embodiment, a simple wire loop will be added after assembly to provide a single-point attachment so that the piñata may swing freely when suspended. The ends of the wire loop pass into the body of the piñata at a suitably provided slot (40), formed by an inward folding of the cardboard. A second piece, shown in FIG. 1B, forms the "head" and helps complete the decorative design, but will not contain treats, so it does not have an access hole. FIG. 1C forms the "ears" when a burro is desired, but is omitted when a dog or horse is called for. Other designs may include a lesser or greater number of pieces, depending on the complexity of the finished design.

Many of the existing designs are of animals, and as shown by the example given, one body shape can often be used for different animals, changing only a part of the head and/or decoration design. In the presently preferred embodiment, for example, one pattern produces the dog, horse, or burro; another model, this one of a bull, can become a lion by removing the horns and changing in the decorations used.

Note that the portions of the pattern which will form the "legs" fold inward so that the legs are part of the overall container and close with a tab that seals in enclosed treats. Narrow wedges (80) incorporated in the folding pattern provide softened edges for the legs.

Figure 5:
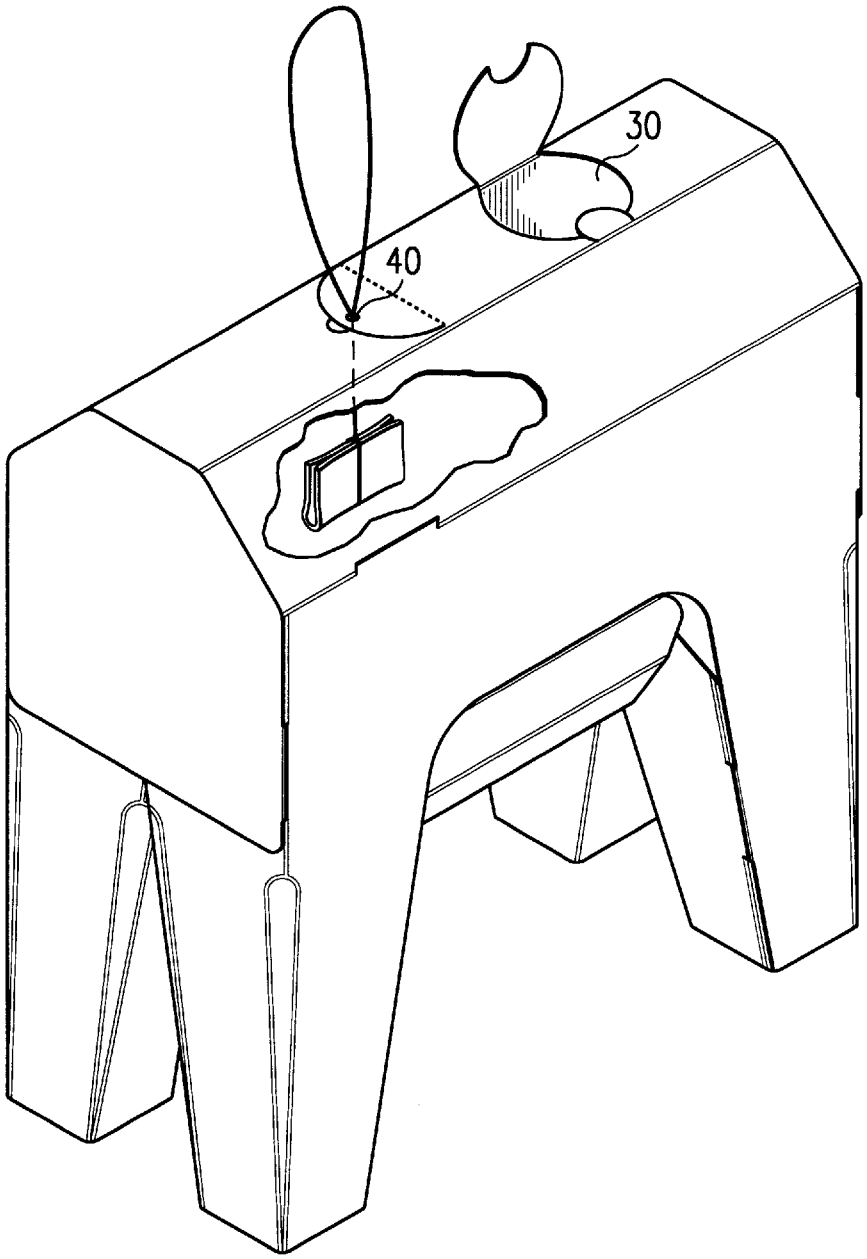
FIG. 5 shows the "body" piece only, and illustrates further several of the features included.

In a design of this type, there will necessarily be a large tab/slot combination (50/60) to close the body portion of the piñata. By designing this opening at the bottom of the body, as shown in FIG. 5, one may advantageously create a non-violent way to open the piñata, i.e., a trapdoor. A small hole (70) designed near the closure of the body allows a string or ribbon to be attached. Pulling on this string will open the body of the piñata and allow treats to fall. In the preferred method of use, the user will loosely attach a multitude of strings to the underside of the piñata, so that all but one of the strings will simply pull away without opening the piñata. The children are then allowed to take turns pulling on the strings, one at a time, until the string is pulled which opens the piñata. This innovation also makes it possible to have a reusable piñata.

Figure 2:
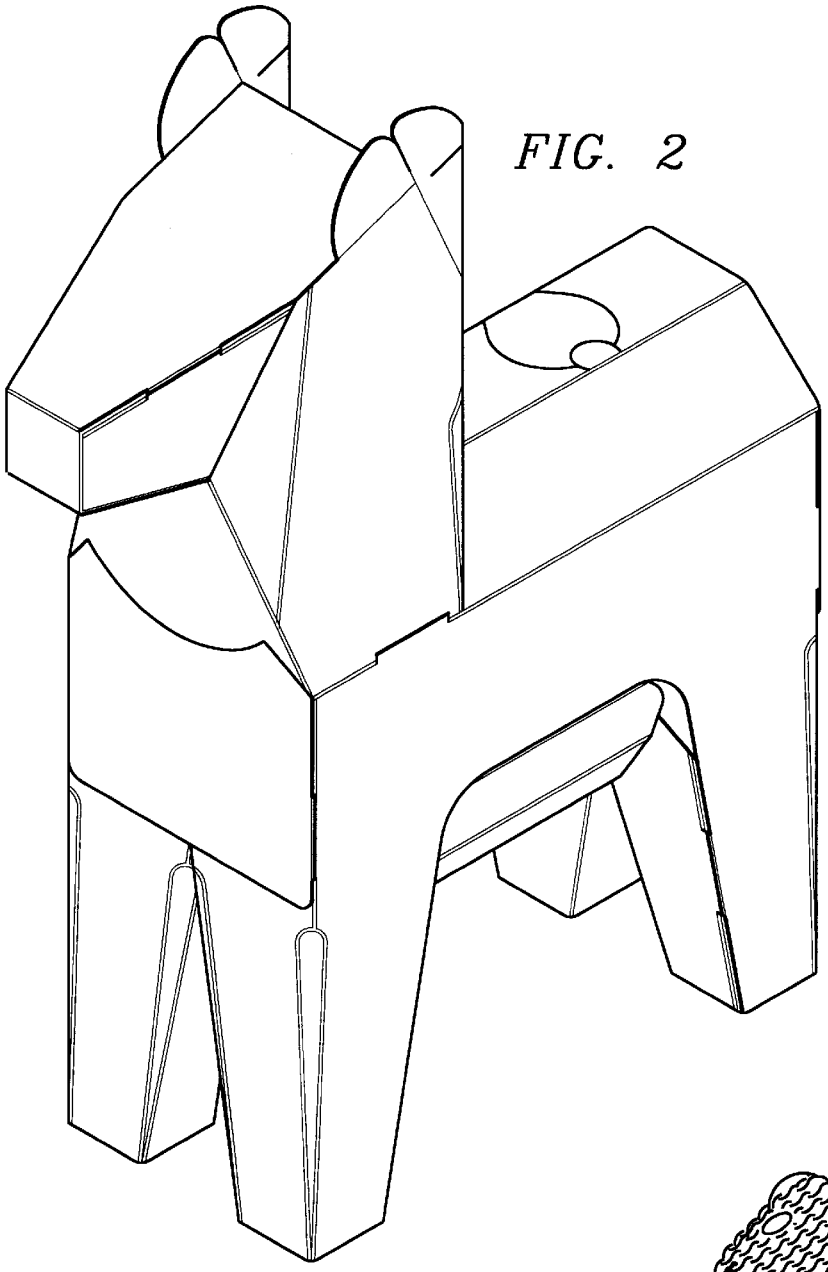
FIG. 2 shows an isometric view of the folded shape made from the pieces of FIGS. 1A and 1B.

FIG. 2 shows the patterns of FIGS. 1A and 1B, now folded into the planned shape, with tabs and slots holding the figure securely together.

FIG. 5 shows a detail of the body portion only, and shows the opening for filling the piñata (30), as well as the slot for attaching a wire loop or other means of suspension (40). In this embodiment, slot 40 also provides one of the slots for mounting the head to the body, though this is not necessarily always the case. The wire loop passes through the slot provided and, in the presently preferred embodiment, is secured around several pieces of cardstock to prevent the loop from slipping out of position.

Figure 4:
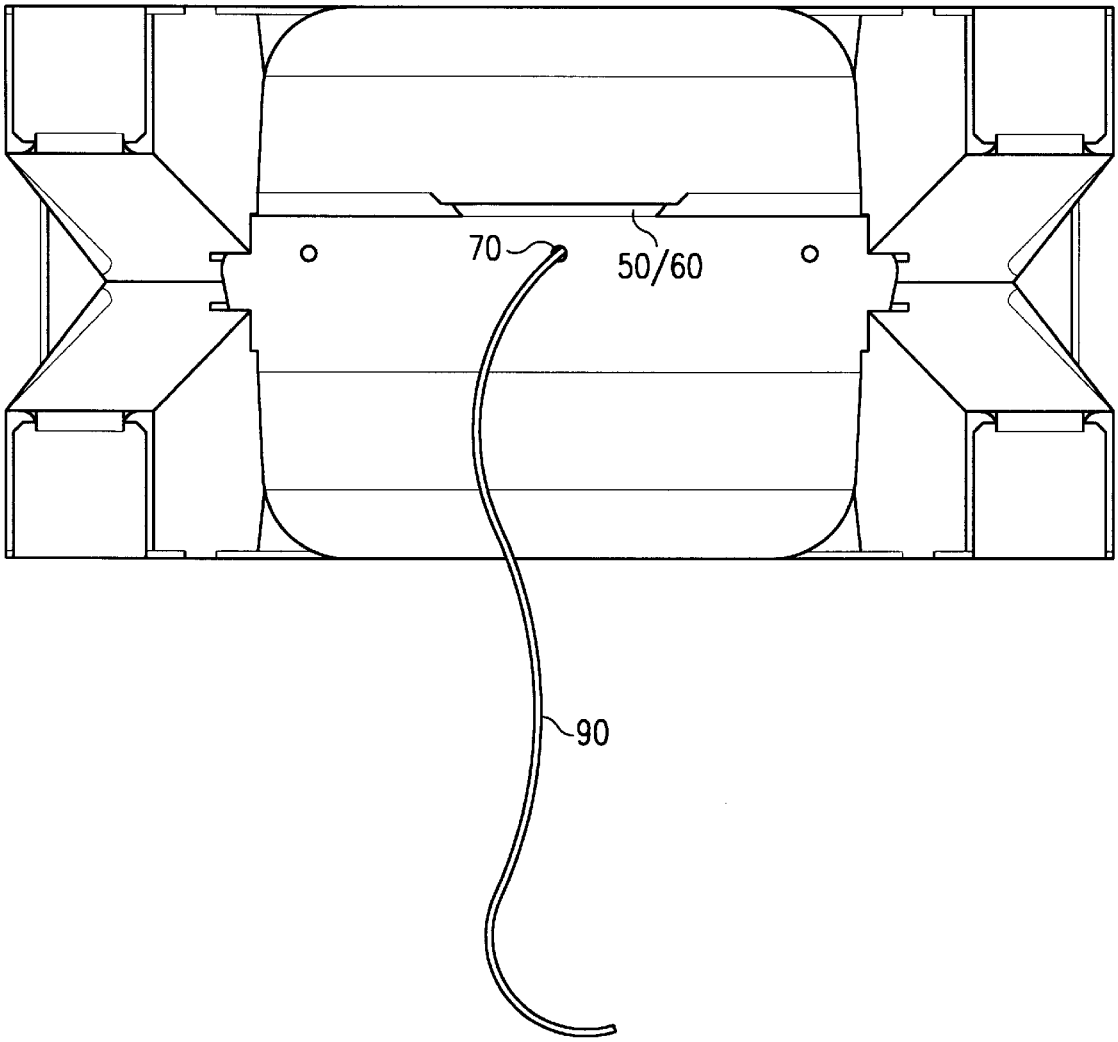
FIG. 4 is a view from the underside of the "body" piece, and illustrates the innovative, non-destructive trapdoor that may be used to open the piñata.

FIG. 4 shows a detail of the same body portion as FIG. 5, this time from the bottom of the piñata, i.e., from between the "legs". From this position, the trapdoor opening is easily seen. Note that in addition to the primary tab/slot closure (50/60) which holds the trapdoor closed, each of the two side of the opening also fits into slots in each of the legs for additional support. Shown is a ribbon or string (90) attached to the piñata through the hole (70). A sharp tug on this string will pull the tabs that secure this opening out of their corresponding slots to open the body of the piñata.

Figure 3:
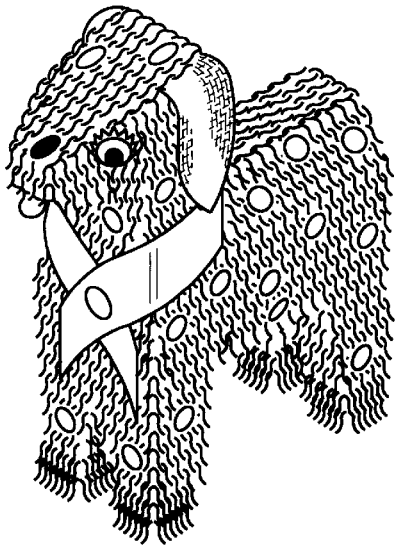
FIG. 3 shows a completed piñata made by the disclosed method.

The piñata will now be decorated. Generally, the manufacturer decorates the piñatas before they are sold, but the folding piñatas are so easy to put together that they may also be sold unassembled, with the purchaser doing the final assembly and decorating. FIG. 3 shows a completed and decorated piñata. The traditional material used for decoration is brightly colored tissue paper cut in fringed strips. These strips of paper are glued into position on the piñata in an overlapping manner, much the same way that shingles are overlapped on a roof. Other decorations may be glued on at the same time, such as a tail or floppy ears for an animal.

The access hole is generally covered over in the decorating. By feeling for the opening through the tissue paper, the purchaser can tear a hole to fill the piñata just prior to use.

MODIFICATIONS AND VARIATIONS

As will be recognized by those skilled in the art, the innovative concepts described in the present application can be modified and varied over a tremendous range of applications, and accordingly the scope of patented subject matter is not limited by any of the specific exemplary teachings given.

For example, while the presently preferred embodiment uses tabs and slots to secure the pieces in position, they may less preferably be fastened with glue, tape, staples, or other fasteners.

Other materials can be less preferably used instead of cardstock, such as sheet plastic, or even sheet metal, if comparably stiff.

Currently, the piñatas are decorated in the traditional manner as explained above, but in an alternative embodiment, printed cardstock can be used to give features to an design or simply to provide a colorful background for other decorations. Alternatively, a spray coating can be applied after assembly to provide texture and/or color.

Hangers other than the loop of wire can be used, such as string or yarn.

The embodiment shown has a single point of attachment for the suspension, but other types of suspension can be used, such as a harness arrangement around the body of the piñata.

The foregoing embodiments are merely illustrative of the possible embodiments. The full scope of the invention is defined only by the issued claims.

What is claimed is:

1. A piñata, comprising:

a hollow container consisting of a first piece of cardstock which has been folded into a predetermined shape, without any structural elements which are not cardstock, wherein said container will hold candy and small treats;

a second piece of cardstock which has been folded into a hollow shape and attached to said hollow container;

retentive elements to fasten portions of said hollow container to each other in said predetermined shape;

an attachment point for attachment of a suspension element to said hollow container;

wherein said container will break when struck sharply.

2. A piñata as in claim 1, wherein said retentive elements are tabs and slots designed to interlock.

3. A piñata as in claim 1, wherein a majority of angles in said hollow container are not right angles.

4. A piñata as in claim 1, wherein said attachment point comprises a slot formed in said hollow container by an infolding of said cardstock.

5. A piñata as in claim 1, wherein said suspension element is a loop of wire.

6. A piñata as in claim 5, wherein said loop of wire passes through a slot in said hollow container and is wrapped around a piece of cardstock to prevent it from slipping out.

7. A piñata as in claim 1, further comprising an opening created by the folding of said cardstock, said opening being held in a closed position by said retentive elements;

a flexible tensile element attached near said opening;

wherein said opening is on a surface opposite said attachment point; and wherein pulling on said flexible tensile element will cause said retentive element holding said opening to release; spilling the contents of said hollow container.

8. A piñata as in claim 1, wherein said hollow container has extremities which are formed by mated interior folds of said cardstock.

9. A piñata as in claim 1, wherein said hollow container has softened corners and edges.

10. A piñata as in claim 1, further comprising a third piece of cardstock which has been folded into a predetermined shape and fastened to said hollow container to add decorative features.

11. A piñata as in claim 1, wherein said hollow container comprises a fold-out fill-hole in top.

12. A piñata as in claim 1, further comprising tissue paper decorations glued to the exterior of said piñata.

13. A piñata, comprising: a hollow container consisting of cardstock which has been folded into a predetermined shape, without any structural elements which are not cardstock, said predetermined shape including a main portion and a portion which extends outward from said main portion, wherein said container will hold candy and small treats;

retentive elements to connect portions of said hollow container to each other in said predetermined shape; and an attachment point for attachment of a suspension element to said hollow container;

wherein said portion of said hollow container which extends outward from said main portion is formed by multiple mated interior folds of said cardstock;

wherein said container will break when struck sharply.

14. A piñata as in claim 13, wherein said retentive elements are tabs and slots designed to interlock.

15. A piñata as in claim 13, wherein said attachment point comprises a slot formed in said hollow container by an infolding of said sheet material.

16. A piñata as in claim 13, wherein said suspension element is a loop of wire.

17. The piñata of claim 13, further comprising tissue paper decorations glued to the exterior of said piñata.

18. A piñata as in claim 17, further comprising a first flexible tensile element attached to said hollow container near said first opening, whereby said container will open when said first flexible tensile element is pulled.

19. The piñata of claim 13, wherein said hollow container has a first opening on a lower surface, capable of being held in a closed position by one of said retentive elements.

20. The piñata of claim 13, wherein each of said folds forms a convex angle with respect to the exterior of said hollow container.

* * * * *